US005833547A

United States Patent [19]

Liang

[11] Patent Number: 5,833,547

[45] Date of Patent: Nov. 10, 1998

[54] BASE STRUCTURE OF A BOWLING PIN

[76] Inventor: Lee Chung Liang, 1F., No. 32, Lane 126, Sec. 3, Chung Yang Road, Tu-Cheng City, Taipei, Taiwan

[21] Appl. No.: 933,510

[22] Filed: Sep. 18, 1997

[51] Int. Cl.[6] ..... A63B 63/00

[52] U.S. Cl. ..... 473/118; 473/124

[58] Field of Search ..... 473/118, 119, 473/120, 121, 122, 123, 124

[56] References Cited

U.S. PATENT DOCUMENTS

| | | | |
|---|---|---|---|
| 4,865,320 | 9/1989 | Unterberger | 473/123 |
| 5,354,239 | 10/1994 | Mueller | 473/124 |
| 5,630,762 | 5/1997 | Mueller | 473/124 |

*Primary Examiner*—William M. Pierce
*Attorney, Agent, or Firm*—Rosenburg, Klein & Bilker

[57] ABSTRACT

The base structure of a bowling pin having an aperture at the center of the base portion thereof for the engagement with the bottom portion of the core of the bowling pin, characterized in that an inner wall is circumferentially provided around the aperture and an outer wall is provided concentrically adjacent to the inner wall, and a circular slot is formed by the inner wall and the outer wall; the outer surface of the outer wall is provided with a plurality of screw threads and at least a pair of transverse hole are provided perpendicular to the circular slot so that the outer surface of the outer wall communicates with the circular slot, whereby a resin solution covers the plurality of the screw threads and flows into the slot, and forms a compact base structure.

1 Claim, 4 Drawing Sheets

BASE STRUCTURE OF A BOWLING PIN

BACKGROUND OF THE INVENTION

FIELD OF INVENTION

The present invention relates to a base structure of a bowling pin, in particular, to a base structure being firmly combined with the bottom portion of the core of the bowling pin.

BACKGROUND OF THE INVENTION

A typical bowling pin consists of a wooden core, an external shell and a base structure. In fabrication, the wooden core having being mounted together with a base structure is placed into a mold. A resin solution is then filled externally into the mold such that the resin solution covers the wooden core and the base structure and according a bowling pin is formed.

FIG. 4 and 5 show the structure of a conventional bowling pin. The lower edge of the core A of the pin is specially made to have an inverted U-shaped slot. This fabrication step is inconvenient at the time of fabricate the core A. In addition, as the base structure B is made to have a shallow slot 1B, when the core A having being combined with the base structure B is placed within a mold and then a resin solution is injected into the mold, the resin solution can only cover the core A and the outer portion of the base structure B. However, due to the surface of the base structure B is smooth, the resin coating enclosed the base structure B is not stable or durable, in particular, the frequent high impact and collision of the pin by a bowling ball will cause the base structure B and the coated layer C to drop off. Thus, the longevity of the pin is greatly reduced.

U.S. Pat. No. 4,322,078 discloses a base structure of a bowling pin, which has a structure similar to the above disclosed conventional pin. The base structure is only weakly covered by a resin coating. Accordingly, the base structure may be easily dislocated from the core of the pin.

U.S. Pat. No. 4,865,320 discloses the base structure of a bowling pin, wherein the base structure is more complicated. In addition, the base portion of the core has to be fabricated into an invented U-shaped configuration. Thus, the pin requires an additional fabrication process and a rubber pad to be mounted at the base structure, and thus the process is more troublesome.

U.S. Pat. No. 5,083,781 discloses the base structure of a bowling pin. However, the base structure only allows the resin coated layer to cover the outer portion of the pin. Accordingly, the resin coated layer may be easily disengaged from the base structure.

SUMMARY OF THE INVENTION

In accordance with the present invention, the base structure of a bowling pin having a vertical aperture at the center thereof to accommodate the wooden core of the pin, characterized in that an inner wall is provided around the vertical aperture and an outer wall is provided concentrically adjacent to the inner wall, a circular slot being formed by the inner wall and the outer wall; the outer surface of the outer wall is provided with a plurality of screw threads and at least a pair of transverse hole are provided perpendicular to the circular slot so that the outer surface of the outer wall communicates with the circular slot, whereby a resin solution covers the plurality of the screw threads and flows into the circular slot, and forms a compact encapsulated base structure.

It is an object of the present invention to provide a base structure for a bowling pin, wherein the combination of the base structure with the resin coated layer provides a strong engagement, which can withstand high collision and impact.

It is another object of the present invention to provide a base structure for a bowling pin, wherein the injected resin solution covers the plurality of screw threads at the surface of the outer wall so as to form a firmly secured base structure for a bowling pin.

These advantages and others will become apparent as the invention is described below with reference to the drawings in which:

DETAILED DESCRIPTION OF THE PREFERRED EMBODIMENT

Figure 1:
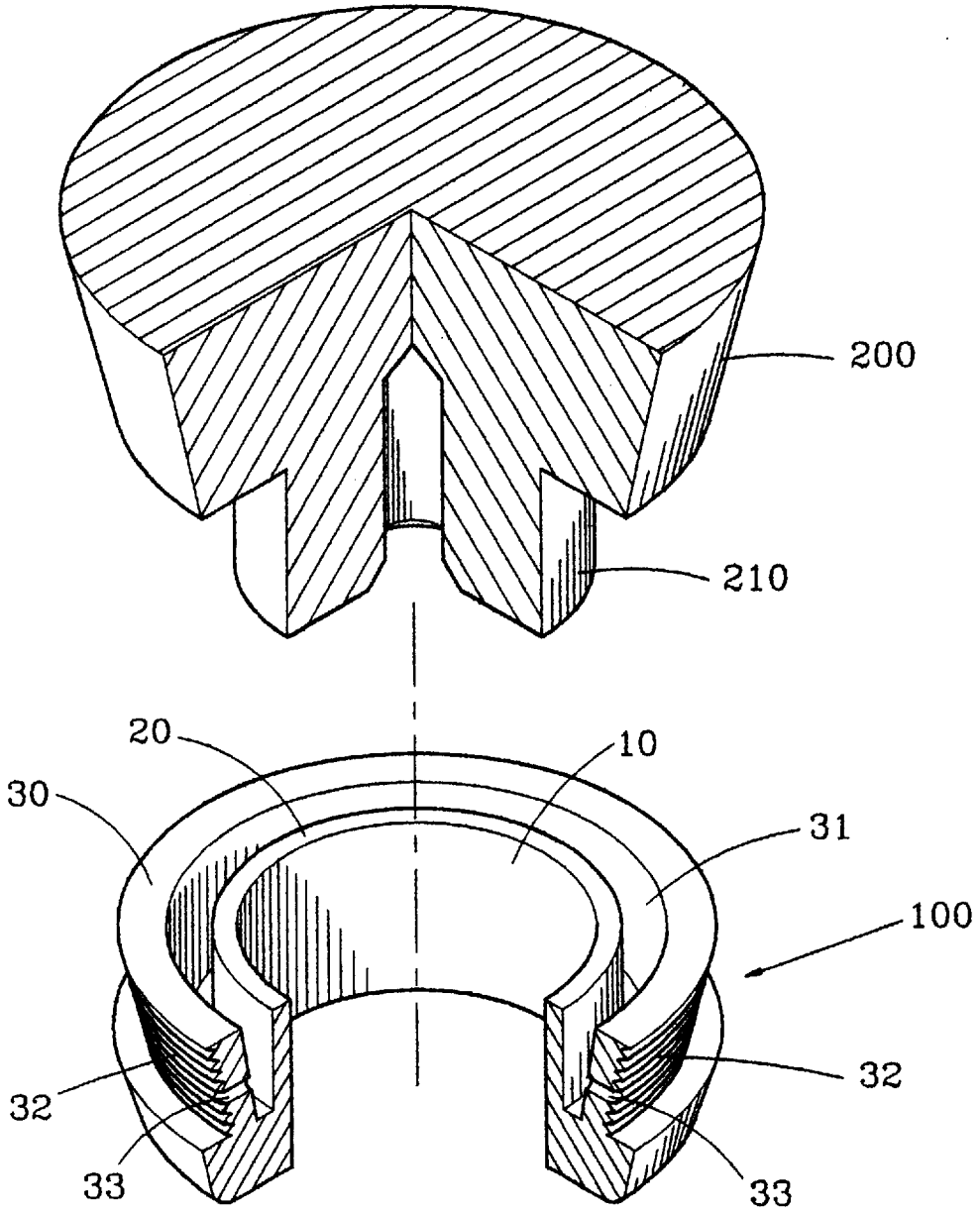
FIG. 1 is an exploded perspective view of the present invention.
Figure 3:
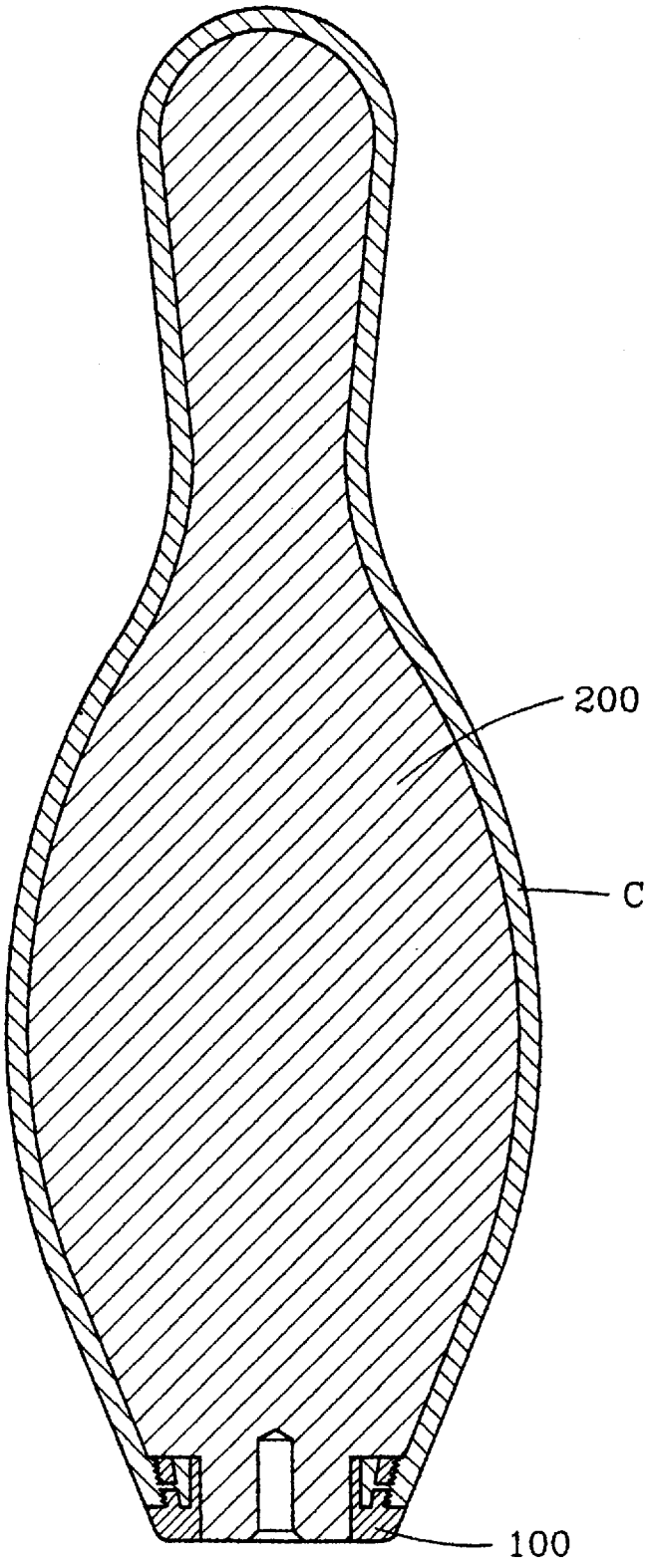
FIG. 3 is a sectional view of a preferred embodiment in accordance with the present invention.
Figure 4:
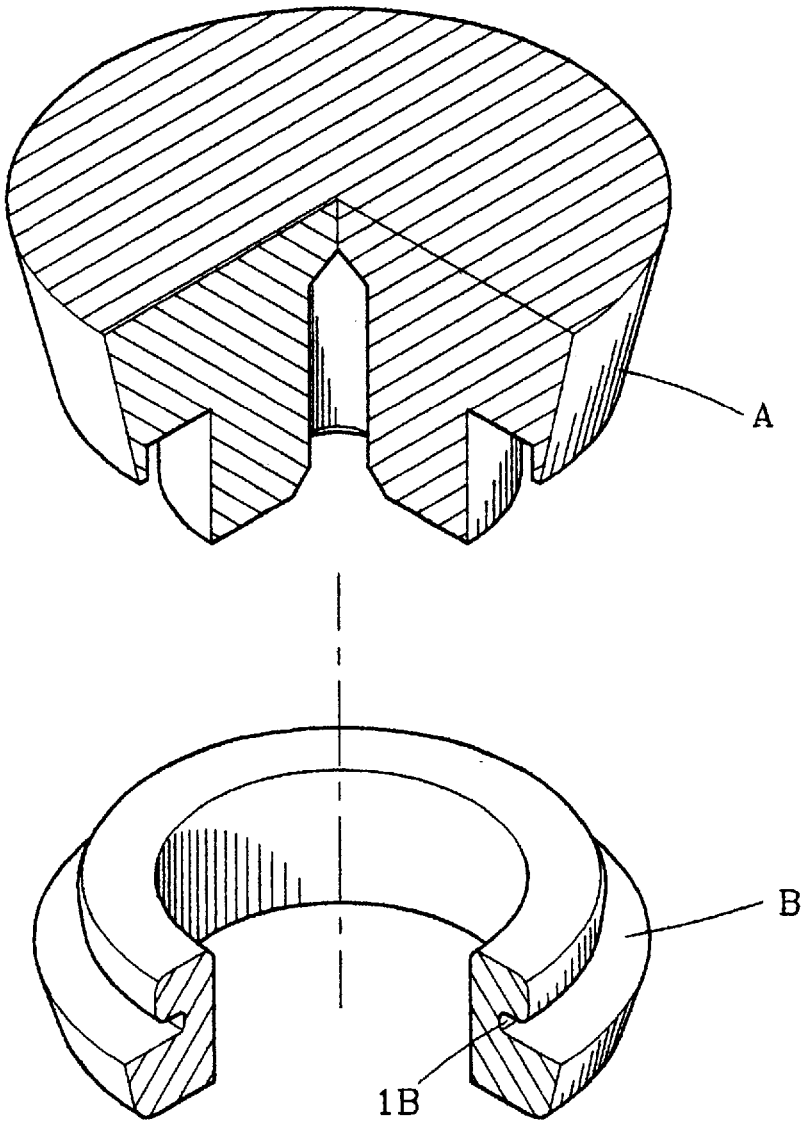
PRIOR ART FIG. 4
FIG. 4 is a prior art.

Reference is first made to FIG. 1 which shows the base structure 100 of a bowling pin (FIG. 3). The base structure 100 has a vertical aperture 10 provided at the center thereof. The aperture 10 is adapted to accommodate the bottom portion 210 of the core 200 of the bowling pin. A circular inner wall 20 is provided along the circumference of the aperture 10, which is concentric with the aperture 10. Adjacent to the inner wall 20, there is provided a circular outer wall 30 which is vertically mounted next to the inner wall 20. A circular slot 31 is formed between the inner wall 20 and the outer wall 30. A plurality of screw threads 32 are provided along the outer surface of the outer wall 30 in a circular direction. The cross-section configuration of the threads 32 can either be an upward zig-zag or downward zig-zag shape. At least a pair of transverse hole 33 is formed perpendicular to the circular slot 31 such that the circular slot 31 is in communication with the outer wall 30.

Figure 2:
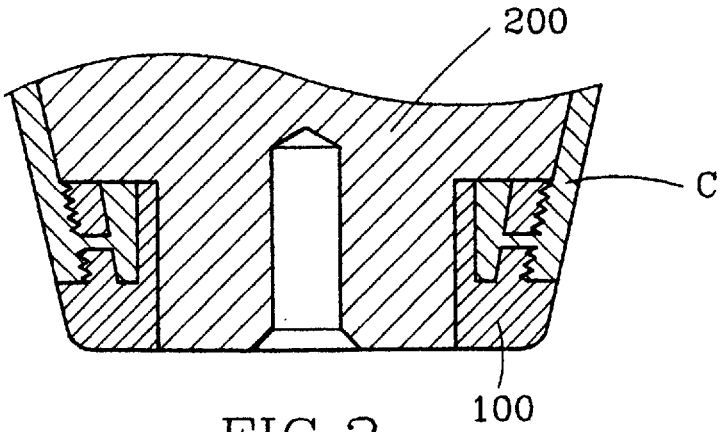
FIG. 2 is a sectional view of the base structure in accordance with the present invention.
Figure 5:
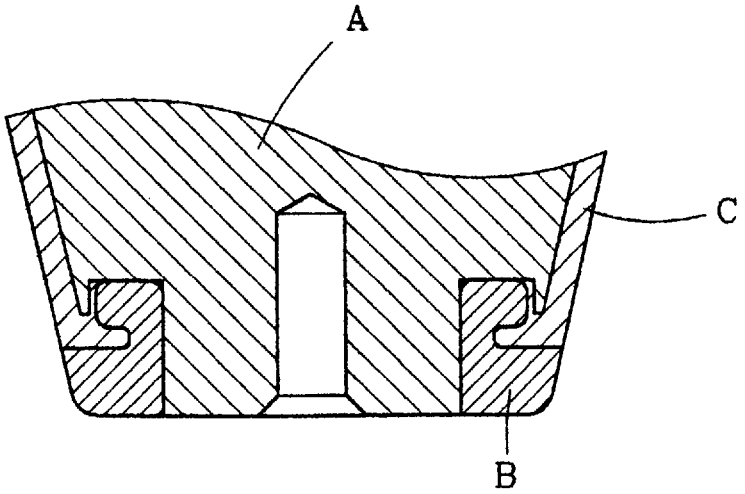
FIG. 5 is a sectional view of FIG. 4.

Referring to FIG. 2, the base structure 100 being combined with the core 200 is placed into a mold. A resin solution is injected into the mold such that the resin solution fills up the outer surface of the core 200 and the outer portion of the base structure 100. According to the present invention, during the injection process of the resin solution into the base structure 100, the resin solution also fills up the gaps formed between the plurality of the screw threads 32. The resin solution at the same time fills up the circular 31 within the base structure 100. When the resin solution is cured, a resin coated layer C encompasses firmly the core 200 and the outer portion of the base structure 100. FIG. 2 shows the resin coated layer C covers the base structure 100. It is to be noted that the base structure 100 not only encloses by the resin coated layer C from the outer surface, the coated layer C also extends to the circular slot 31 and the transverse hole 33 within the base structure 100, such that the base structure 100 and the resin coated layer C form into a compact structure.

FIG. 3 shows the base structure 100 of a bowling pin in accordance with the present invention. In practical, as shown in FIG. 3, the base structure 100 can be firmly secured to the plurality of screw threads 32 at the surface of the outer wall

30 with strong bonding of the resin coated layer C to the base structure 100, such that the base structure 100 will not dislocated. Additionally, the circular slot 31 and the transverse hole 33 within the outer wall 30, and the vertical aperture 100 of the base structure 100 allow the enclosure of the base structure 100 by the resin coated layer C. Accordingly, the base structure 100 obtained in accordance with the present invention can be firmly secured with the bottom portion of the core 200, which enhances its impact and collision, and thus enhances its longevity of the bowling pin.

It will be appreciated from the foregoing that the invention can take various shapes and forms without departing from the essential spirit or scope of the invention.

We claim:

1. A base structure of a bowling pin comprising a base portion having a centrally disposed aperture formed therethrough for engagement with a bottom portion of a core portion of a bowling pin, said base portion having (a) an inner wall circumscribing said aperture, (b) an outer wall concentrically spaced from said inner wall, said outer wall having an outer surface portion with threads formed thereon for coupling with a resin solution overlaid on said bowling pin core portion and said threads, and (c) an annular slot formed between said inner and outer walls, said outer wall having at least a pair of holes formed transversely therethrough and in open communication with said annular slot for passage of the resin solution into said annular slot through said holes.

* * * * *